United States Patent [19]

Northup, Jr.

[11] 4,233,468

[45] Nov. 11, 1980

[54] HOLDER ATTACHMENT FOR USE WITH FURNACE HARDWARE

[76] Inventor: John A. Northup, Jr., 134 Main St., Unionville, Conn. 06085

[21] Appl. No.: 965,525

[22] Filed: Dec. 1, 1978

[51] Int. Cl.[3] ..... H05B 3/66

[52] U.S. Cl. ..... 13/25; 13/35; 52/410; 52/506

[58] Field of Search ..... 52/27, 506, 410; 13/25, 13/20, 35

[56] References Cited

U.S. PATENT DOCUMENTS

| | | | |
|---|---|---|---|
| 3,705,253 | 12/1972 | Hicks | 13/25 X |
| 3,738,217 | 6/1973 | Walker | 52/506 |
| 4,011,394 | 3/1977 | Shelley | 13/25 X |
| 4,154,975 | 5/1979 | Sauder | 13/25 |
| 4,156,792 | 5/1979 | McFadden et al. | 13/25 |

*Primary Examiner*—Roy N. Envall, Jr.

*Attorney, Agent, or Firm*—McCormick, Paulding & Huber

[57] ABSTRACT

A holder attachment for securing a heating element to a wall of a furnace is held in place by studs which project from the furnace wall and impale the wall lining material and locking anchor washers engaged with projecting end portions of the studs. The holder assembly includes an elongated rod received on and extending between a pair of adjacent studs and a plurality of ceramic holding members carried by the rod and each having a hook-shaped portion engaged with the heating element.

7 Claims, 7 Drawing Figures

FIG. 1
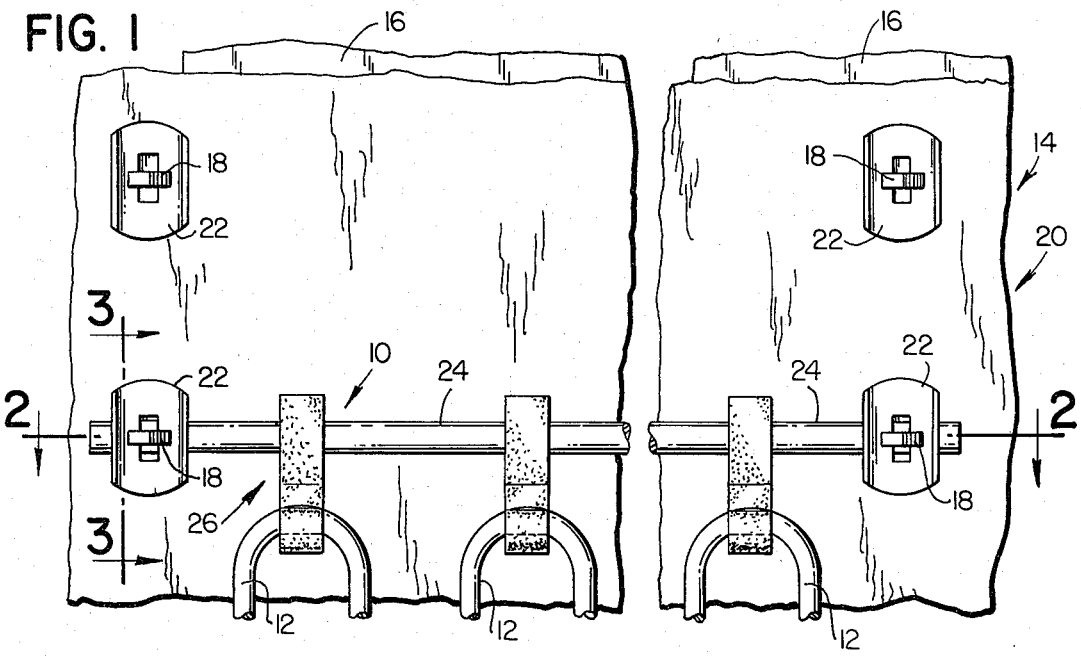
FIG. 2
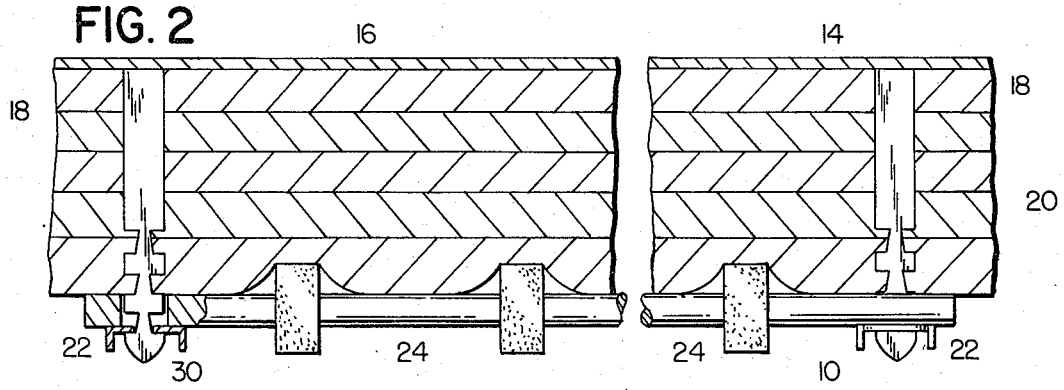
FIG. 3
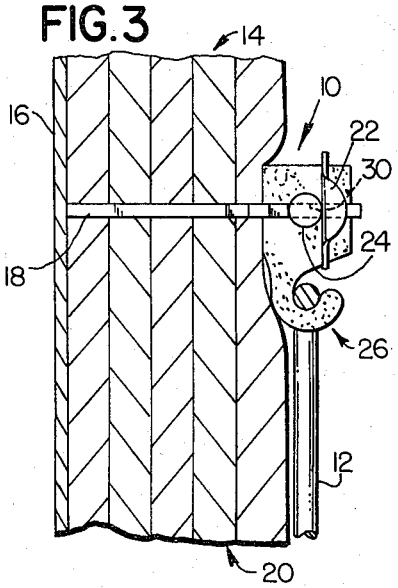
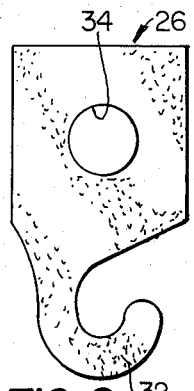
FIG. 6
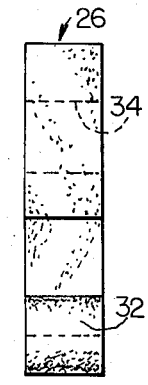
FIG. 7
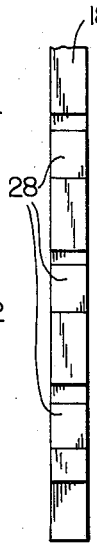
FIG. 5
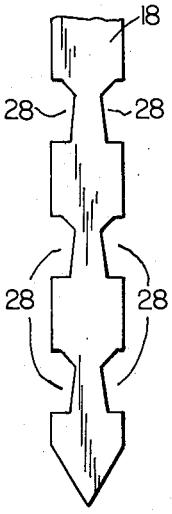
FIG. 4

HOLDER ATTACHMENT FOR USE WITH FURNACE HARDWARE

BACKGROUND OF THE INVENTION

This invention relates in general to hardware for heat containment systems and deals more particularly with an improved holder assembly for attachment to other hardware used to secure refractory lining material to a wall of a furnace or the like. In a heat containment system or furnace of the type with which the present invention is concerned, one or more layers of lining material are secured to a wall by studs which are attached to and project from the wall to impale the lining material and locking anchor washers engaged with projecting free ends of the studs and retaining the lining material in place. Such a furnace may require heating elements which are usually secured in fixed position to the furnace walls. It is the general aim of the present invention to provide an improved holder assembly for a heat containment system or furnace of the aforedescribed general type and which utilizes existing furnace hardware to secure heat elements or the like in fixed position relative to the walls of a furnace.

SUMMARY OF THE INVENTION

In accordance with the present invention a holder assembly is provided for use in a heat containment system which includes a casing wall having studs projecting therefrom and at least one layer of lining material impaled on the studs and secured thereon by anchor washers. The holder assembly comprises a support member which has spaced apart holes for receiving associated projecting end portions of studs therethrough, at least one attaching member having means for attaching an article thereto, and means for securing the one attaching member to the support member. The support member is retained on the studs by the anchor washers.

BRIEF DESCRIPTION OF THE DRAWING

FIG. 1 is a fragmentary elevational view of the furnace wall shown with a holder assembly embodying the invention attached thereto.

FIG. 2 is a sectional view through the furnace wall taken along the line 2—2 of FIG. 1.

FIG. 3 is a sectional view taken along the line 3—3 of FIG. 1.

FIG. 4 is a somewhat enlarged fragmentary plan view of a typical stud.

FIG. 5 is a fragmentary side elevational view of the stud of FIG. 4.

FIG. 6 is a somewhat enlarged end elevational view of an attaching member.

FIG. 7 is a front elevational view of the attaching member of FIG. 6.

DETAILED DESCRIPTION OF PREFERRED EMBODIMENT

Turning now to the drawing, and referring particularly to FIGS. 13, a holder assembly or attachment embodying the present invention, and indicated generally at 10, carries a heating element 12 and is shown mounted on a heat containment system or industrial furnace indicated generally by reference numeral 14. The furnace 14 has a casing which includes a wall 16. A plurality of studs 18, 18, attached to the wall 16 project inwardly therefrom and carry refractory lining material indicated generally at 20. The lining material is impaled on the studs 18, 18, and retained in position by locking anchor washers 22, 22 engaged with the projecting end portions of the studs, substantially as shown. The holder attachment 10 generally comprises a support member 24, mounted on a plurality of studs 18, 18, and at least one attaching member indicated generally at 26 carried by the support member for attaching an article such as the heating element 12 to the support member.

Considering now the furnace 14 in further detail, the studs 18, 18 may be made of metal and welded directly to the steel casing of the furnace or may be made from ceramic material and threaded onto metallic stud bases which are welded to the furnace casing or shell. However, the illustrated studs 18, 18 are of the metallic type. Each stud 18 comprises a metallic rod of generally rectangular cross section which has a series of pairs of locking notches 28, 28 spaced from its free end. The notches 28, 28 of each pair open laterally outwardly through opposite sides of the stud and are shaped substantially as shown in FIG. 4.

The lining material 20 comprises the hot face lining of the furnace 14 and is resilient and at least somewhat compressible. It includes at least one layer of refractory material, but may, for example, be formed by a plurality of layers of ceramic fibre felts, blankets or boards. If a ceramic fibre board product is used as a lining material, a layer of compressible material, such as a ceramic fibre blanket or ceramic fibre matt, is preferably used as backup insulation to provide a desired degree of compressibility.

A typical anchor washer 22 is formed from flat metal and has bent ears at opposite sides to facilitate handling and positioning. A central opening in the locking washer has a generally rectangular cross section to generally complement the major cross section of an associated stud 18, so that the washer may be received on the stud. Furnace lining hardware which includes studs and locking anchor washers, is presently available in different sizes and metallurgy to accommodate a variety of lining thicknesses and operating temperatures, and such hardware is marketed by Johns-Manville, Denver, Colorado, and is well known to those skilled in the furnace lining art.

Further considering the holder attachment 10, the support member 24 preferably comprises a cylindrical metal rod metallurgically compatable with the anticipated operating temperatures of the furnace. Longitudinally spaced apart holes 30, 30, formed in the rod are adapted to receive associated projecting end portions of studs 18, 18. Preferably and as shown, each hole 30 comprises a longitudinally extending rectangular slot. Each slot 30 is somewhat larger than the corresponding major cross section of an associated stud 18 so that the stud may freely enter the slot. The length of the support rod may vary and may, of course, be determined by the requirements of a specific furnace application. However, it is contemplated that support rods be furnished in standard lengths for use in standard installations.

A typical attaching member 26 shown in FIGS. 6 and 7 is made from ceramic material, such as firebrick, and has a generally rectangular upper portion and a hook shaped lower portion 32, substantially as shown in FIG. 6. A bore 34 extends through the upper portion for receiving the support rod 24 therethrough. The hook shaped portion 32 is designed to accommodate a particular article to be attached to a wall of the furnace, as for example, the serpentine heating element 12, shown in FIG. 1.

In making a furnace lining installation, the studs 18, 18 are first attached to a wall of the furnace shell. The components which comprise the lining material 20 are next impaled upon the studs. A support rod 24 with one or more attaching members 26 positioned thereon is then positioned on the projecting ends of associated studs. The studs which carry the supportrod will, of course, be prepositioned on the furnace shell in properly spaced relation to accommodate the support rod. However, if necessary, the free ends of the studs 18, 18 which are to receive the support rod may be bent toward or away from each other to attain proper alignment with holes 30, 30 in the rod. The holder assembly 10 is now pushed into the lining 20 to compress the lining to a sufficient degree to expose one or more pair of locking notches 28, 28 in projected position beyond the rod 24. Each washer 22 is placed on the inwardly projecting end of an associated stud and pushed outwardly in the direction of the lining and to a position wherein it is aligned with an associated pair of locking notches 28, 28. Each washer is pushed to the outer or lining end of an associated pair of notches 28, 28 and then rotated 90 degrees relative to its associated stud and released. The resilient lining material 20 then pushes the holder assembly 10 and the locking washers 22, 22, which secure it, in a direction away from the wall 14 so that each locking washer jambs in locked position at the inner end of its respectively associated pair of locking notches 28. Each washer 22 will remain locked on its associated stud until it is manually pushed outwardly toward the lining material 20 to its unlocked position at the outer end of its associated locking notches and again rotated 90 degrees relative to its associated stud. The installation is complete when a locking washer 22 has been placed in locked position on the free end of each stud 18 to retain the holder assembly 10 and to further secure the furnace lining material 20.

I claim:

1. A holder attachment for a heat containment system having a wall, a plurality of studs attached to the wall and projecting therefrom, at least one layer of lining material impaled on the studs, and a plurality of anchor washers, each of said washers received and retained on an associated one of the studs, the studs and the anchor washers securing said lining material to the wall, said holder attachment comprising a support member having spaced apart holes for receiving associated studs therethrough, said support member adapted to be received on the associated studs between the lining material and the anchor washers on the associated studs, at least one attaching member having means for attaching an article thereto, and means for securing said one attaching member to said support member.

2. A holder attachment for a heat containment system as set forth in claim 1 wherein said support member comprises an elongated rod.

3. A holder attachment for a heat containment system as set forth in claim 2 wherein said holes comprise slots extending longitudinally of said rod.

4. A holder attachment for a heat containment system as set forth in any one of claims 1 through 3 wherein said means for attaching an article comprises a hook formed on said attaching member.

5. A holder attachment for a heat containment system as set forth in any one of claim 1 through claim 3 wherein said attaching member is made from refractory material.

6. A holder attachment for a heat containment system as set forth in one of claims 1 through 3 wherein said securing means comprises a hole in said attaching member receiving said support member therethrough.

7. A heat containment system having a wall, a plurality of studs attached to said wall and projecting therefrom, at least one layer of lining material impaled on said studs, a holder attachment including an elongated rod having longitudinally extending slots therein, each of said slots receiving the free end portion of an associated one of said studs therethrough, and a ceramic attaching member having a bore receiving said rod therethrough and a hook formed thereon, and a plurality of locking anchor washers, each of said anchor washers lockingly engaging the free end portion of an associated one of said studs.

* * * * *